US006390149B1

(12) United States Patent
Arbey et al.

(10) Patent No.: US 6,390,149 B1
(45) Date of Patent: May 21, 2002

(54) DEVICE FOR EMPTYING A CONTAINER OF VISCOUS FLUID

(75) Inventors: Thierry Arbey, Paris; Patick Gastaldello, Le Mee, both of (FR)

(73) Assignee: Arbey Thierry, Paris (FR)

( * ) Notice: Subject to any disclaimer, the term of this patent is extended or adjusted under 35 U.S.C. 154(b) by 0 days.

(21) Appl. No.: 09/831,819

(22) PCT Filed: Nov. 12, 1999

(86) PCT No.: PCT/FR99/02775

§ 371 Date: Jul. 5, 2001

§ 102(e) Date: Jul. 5, 2001

(87) PCT Pub. No.: WO00/29725

PCT Pub. Date: May 25, 2000

(30) Foreign Application Priority Data

Nov. 16, 1998 (FR) ..... 98 14295

(51) Int. Cl.[7] ..... B65B 1/04; B65B 3/04; B67C 3/02

(52) U.S. Cl. ..... 141/98; 141/27; 141/65; 184/1.5

(58) Field of Search ..... 141/18, 27, 47, 141/59, 65, 98; 184/1.5

(56) References Cited

U.S. PATENT DOCUMENTS 5,002,154 A 3/1991 Chen ..... 184/1.5

*Primary Examiner*—Timothy L. Maust
(74) *Attorney, Agent, or Firm*—Sughrue Mion, PLLC

(57) ABSTRACT

Devices for emptying a container of viscous fluid in an ambient medium where there exists an atmosphere under pressure and a force of gravity. The device of the invention is essentially characterized by the fact that it comprises a receptacle 1 having a main volume 2 comprising top and bottom portions 3 and 4 and in which a separation wall 5 defines two secondary volumes 6 and 7, an orifice 8 made through the wall 5 to put the two secondary volumes 6 and 7 into communication, and opening out into the secondary volume 7 in the top portion 3 of the main volume, a pump 10 mounted to co-operate with the receptacle 1, its suction inlet 11 being in the volume 6 and its outlet 12 opening out to the outside 13 of the receptacle 1, a tube 14, and means 17 for mounting the tube 14 in association with the receptacle 1 so that its outlet opening 16 is situated in the secondary volume 7 and its inlet opening 15 lies outside the receptacle 1. The invention is particularly applicable to changing engine oil in motor vehicles, or the like.

9 Claims, 2 Drawing Sheets

DEVICE FOR EMPTYING A CONTAINER OF VISCOUS FLUID

The present invention relates to devices making it possible in a medium where there exists an atmosphere under pressure and a force of gravity, to empty a container of viscous fluid, which devices find a particularly advantageous application in changing the oil contained in the engines of motor vehicles or the like.

Devices already exist for emptying containers of viscous fluids. However, those known devices present structures that are complex and that put considerable limits on their use, in particular by individuals desirous of performing their own oil changes on their own motor vehicles.

Figure 1:
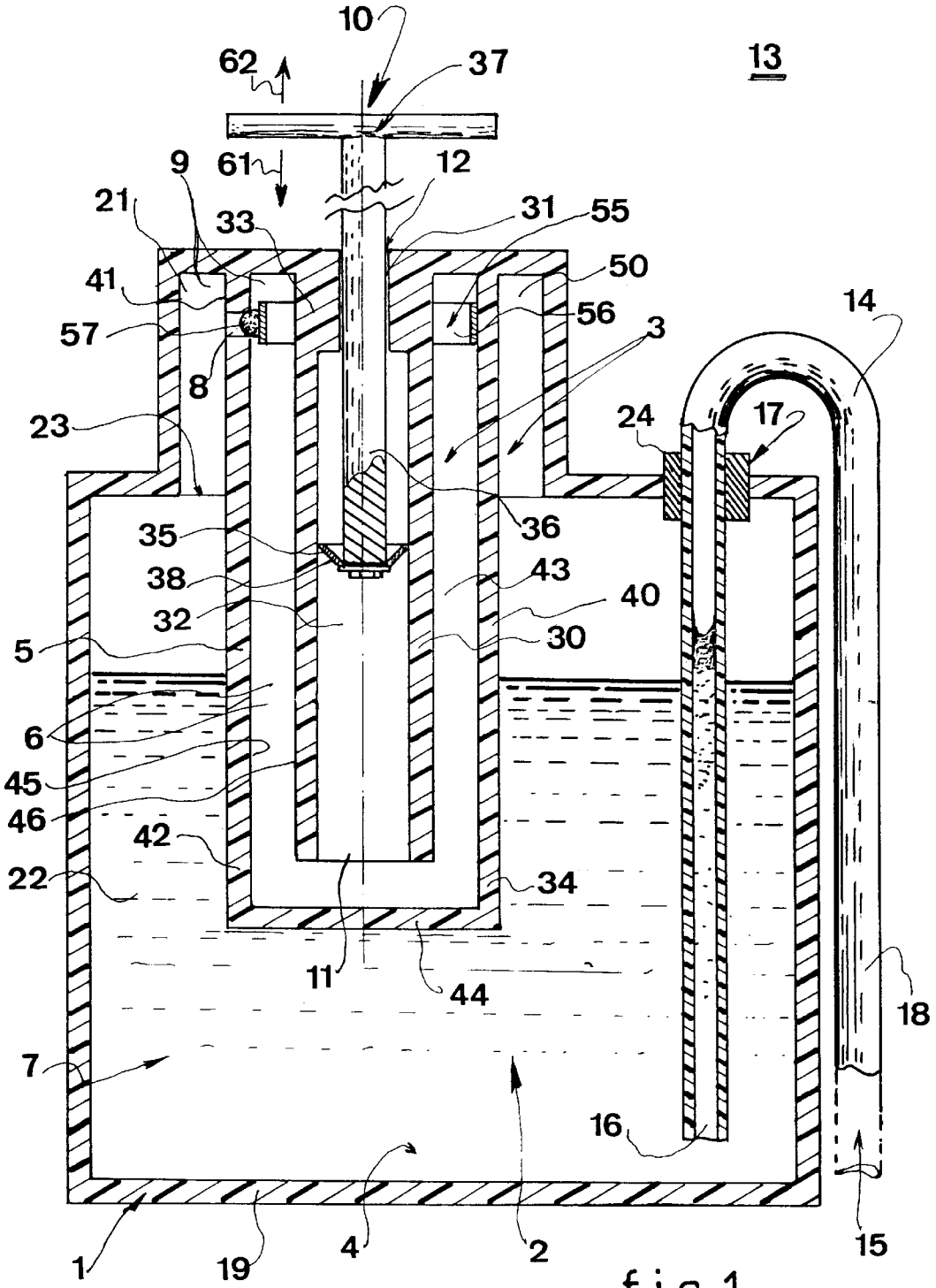

An example of such a device is described in U.S. Pat. No. 1,439,295. The device described in that document comprises a pump placed in a housing arranged in the main receptacle suitable for collecting the substance to be emptied out such as oil or the like. The pump has a suction inlet placed in the bottom of the pump body. That suction inlet needs to be put into communication with the top of the receptacle and it is necessarily connected thereto by means of a hose enabling the pump to be placed in its housing, as shown in FIG. 1 of that document.

Such a structure presents undoubted drawbacks. In particular, it puts a limit on the suction that the pump can generate. Beyond a certain amount of suction, the hose might collapse. Furthermore, it is very difficult to make leakproof passages at both ends of the hose, specifically because of its flexibility. Finally, such a device is unsuitable for being mounted manually and its structure is unsuitable for industrializing by mass production.

Thus, an object of the present invention is to provide a device that makes it possible in a medium where there exists an atmosphere under pressure and a force of gravity, to empty a container of viscous fluid, which device is very simple in structure, easy to make, of very low cost price, and can be used by anybody whether professionals or private individuals.

More precisely, the present invention provides a device usable, in a medium where there exists an atmosphere under pressure and a force of gravity, to empty a container of viscous fluid, the device comprising:

- a receptacle defining a main volume suitable for containing said viscous fluid, said receptacle being shaped to be suitable for placing in said medium so that the main volume has a top portion and a bottom portion;
- a pump having a suction inlet and a delivery outlet;
- a tube including an inlet opening and an outlet opening; and
- means for mounting the tube in association with the receptacle in such a manner that the inlet and outlet openings are situated respectively outside and inside the receptacle, the end of the tube including the inlet opening being suitable for dipping into the container that is to be emptied;

the device being characterized by the fact that it further comprises a separation wall for defining first and second secondary volumes inside the main volume, the first secondary volume including at least a fraction of the top portion of the main volume, and an orifice made through the separation wall to put the first and second secondary volumes into communication with each other, said orifice opening out into the second secondary volume in said fraction of the top portion of the main volume, by the fact that said pump is mounted to co-operate with the receptacle so that its suction inlet is situated in the first secondary volume, and its delivery outlet opens out to the outside of the receptacle, and that the outlet opening of the tube is situated in the second secondary volume.

Figure 2:
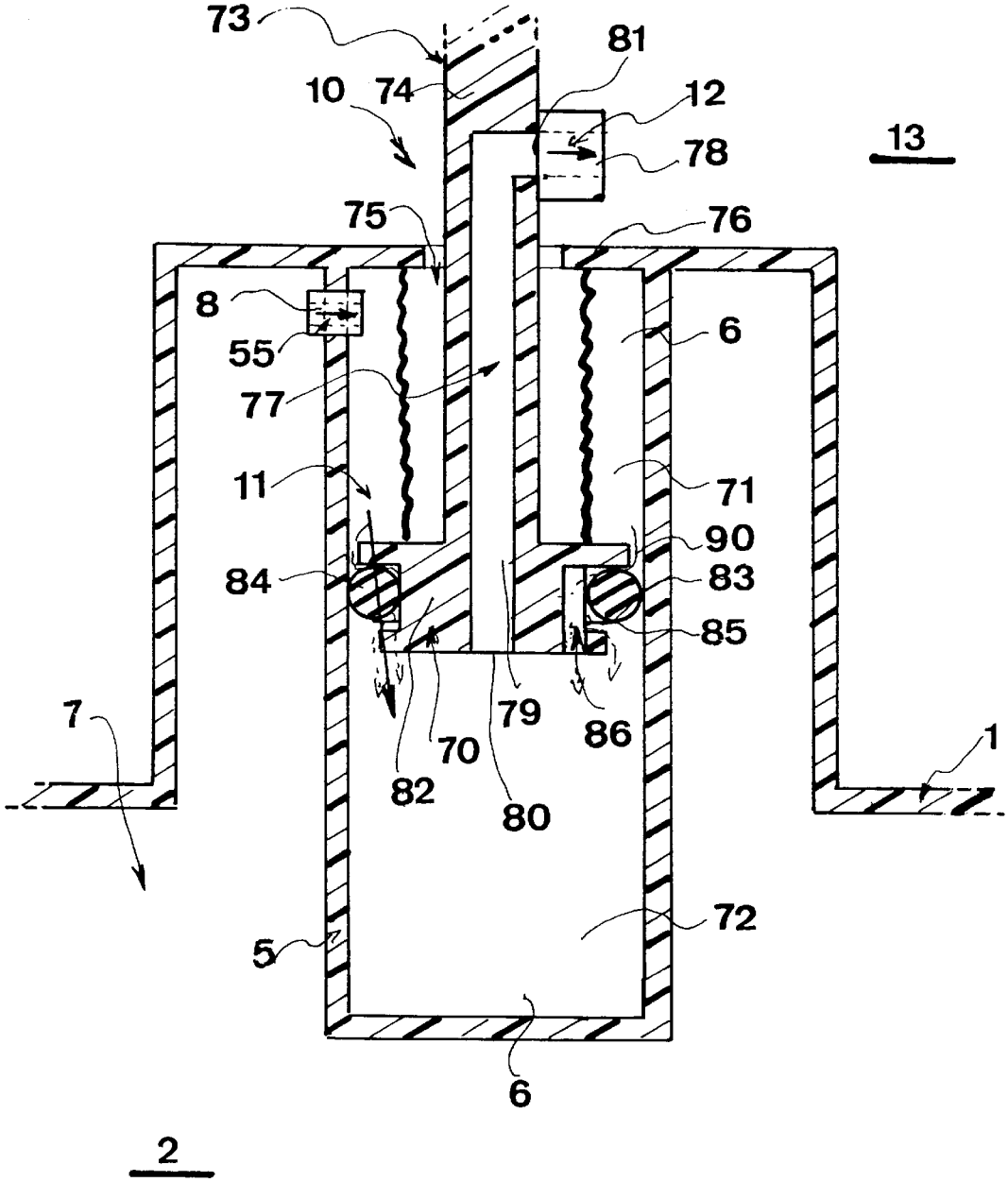

Other characteristics and advantages of the present invention will appear from the following description given with reference to the accompanying drawings by way of non-limiting illustration, and in which:

FIGS. 1 and 2 are diagrammatic section views through two respective embodiments of a device of the invention for emptying a container of viscous fluid.

Although FIGS. 1 and 2 show two embodiments of the device of the invention, it is specified that the same references therein are used to designate the same elements or means regardless of the figure in which they appear and regardless of the way in which the means are shown.

The device, one embodiment of which is shown in FIG. 1, serves to empty a container of viscous fluid such as the oil contained in the engine unit of a motor vehicle or the like, in a medium in which an atmosphere exists under pressure and in which there is a force of gravity, as in ambient air as it exists on Earth.

The device comprises a receptacle 1 having a wall 19 that defines a main volume 2 suitable for containing a viscous fluid, the receptacle being shaped to be suitable for placing in the ambient medium so that the main volume has a top portion 3 and a bottom portion 4.

A separation wall 5 situated in the main volume 2 subdivides said main volume into first and second secondary volumes 6 and 7, the first secondary volume 6 including at least a fraction 9 of the top portion 3 of the main volume 2.

An orifice 8 is made through the separation wall 5 to establish communication between the first and secondary volumes 6 and 7, said orifice opening out into the second secondary volume 7 in the above-defined fraction 9 of the top portion 3 of the main volume.

The device also includes a pump 10 having a suction inlet 11 and a delivery outlet 12. The pump is mounted to co-operate with the receptacle 1, and more particularly with its wall 19 as described below, so that its suction inlet 11 is situated in the first secondary volume 6 and its delivery outlet 12 opens out to the outside 13 of the receptacle 1.

The device also comprises a tube 14 having an inlet opening 15 and an outlet opening 16, and means 17 for mounting said tube 14 in association with the receptacle 1 in such a manner that its outlet opening 16 is situated in the second secondary volume 7 and its inlet opening 15 is situated outside the receptacle 1, the end 18 of the tube 14 that includes the inlet opening 15 being shaped so as to be suitable for dipping into the container to be emptied.

In preferred and advantageous manner, the end 18 of the tube 14 having the inlet opening 15 is flexible so as to be easily dipped down to the bottom of the largest possible number of containers of any shape, and the above-defined means 17 are advantageously constituted by a sealed passage 24 through the wall 19 of the receptacle 1.

This sealed passage is advantageously coupled to a removable stopper so as to enable the receptacle 1 to be emptied when it has become relatively full, thus enabling the device to be reused for another oil change.

Also preferably, the device is arranged in such a manner that the secondary volume 7 as defined above is subdivided into first and second auxiliary volumes 21 and 22, these two auxiliary volumes communicating with each other via a constriction 23 that is preferably formed between the wall 19 of the receptacle and the separation wall 5, said constriction constituting a large head loss for the viscous fluid.

The first auxiliary volume 21 is situated in the top portion 3 of the main volume 2 and the orifice 8 opens out into said first auxiliary volume 21.

As mentioned above, the device includes a pump 10. In an advantageous embodiment, the pump 10 comprises a cylindrical body 30 having a first end 33 secured in leakproof manner to the wall 19 of the receptacle 1 and having its opposite end 34 opening out into the first secondary volume 6; a piston 35 is slidably mounted in the cylindrical body 30; a control rod 36 moves the piston in translation; and a valve 38 is provided to cooperate with the piston 35, said valve being open when the control rod 36 penetrates by moving in translation into the cylindrical body 30 in the direction marked by arrow 61 in the figure, and being closed when the control rod moves out from the cylindrical body in translation as marked by arrow 62 in the same figure. In addition, the control rod 36 is made in such a manner that it passes without sealing through an opening 31 made in the wall 19 of the receptacle and one of its ends (37) is always situated outside the receptacle 1.

As shown in FIG. 1, the separation wall 5 is advantageously constituted by a cylindrical sleeve 40 of a length that is longer than that of the cylindrical body 30, said sleeve being secured at one end 41 to the wall 19 of the receptacle 1 so as to be substantially concentric about the cylindrical body 30 and defining between its inside face 45 and the outside face 46 of the cylindrical body a first annular space 43, and further being constituted by a plug 44 that closes the other end 42 of the sleeve 40 in leakproof manner.

In a preferred embodiment, the first auxiliary volume 21 forms a second annular cylindrical space 50 around the sleeve 40 and of the same thickness as the above-defined constriction, said second annular space 50 being shorter in length than the sleeve 40, as can be seen in the figure.

For safety reasons and in order to obtain proper operation regardless of the volume of fluid to be emptied out, the device includes a valve member 55 mounted to cooperate with the orifice 8 in such a manner as to open for flow going from the second secondary volume 7 towards the first secondary volume 6.

In an advantageous embodiment, the valve member 55 is constituted by a resilient ring 56 mounted in the first annular space 43 and by a closure stud 57 mounted to co-operate with the ring 56 in such a manner as to be suitable for closing the orifice 8 under the resilient drive exerted by the ring, and to move away from said orifice when the surrounding atmosphere is sucked in by the pump 10 so as to pass from the second secondary volume 7 towards the first secondary volume 6, in a manner that is described below.

With a device having the structure as described above, it is advantageous for at least the receptacle 1, the separation wall 5, the tube 14, and the cylindrical body 30 all to be made of a plastics material, in particular by molding, thereby contributing to considerably reducing the cost of manufacturing this device of the invention.

The above-described device operates and is used as follows:

Firstly, it is assumed that the device is used in a medium where there exists an atmosphere under pressure and gravitational force, e.g. on Earth, and that the receptacle 1 is initially completely empty of any liquid and that it is to be used for emptying out the oil contained in the engine unit (not shown) of a motor vehicle or the like.

The end 18 of the tube 14 is inserted into the engine unit so that its inlet opening 15 is dipped into the oil, and preferably all the way down to the bottom of the engine unit.

The control rod 36 is then moved back and forth along arrows 61 and 62 so that the piston 35 travels along the inside 32 of the cylindrical body 30.

When the rod is pushed in along arrow 61, the valve 38 is open and the piston 35 moves in without significantly moving the atmosphere that is to be found within the cylindrical body.

Conversely, when the control rod 36 is raised along arrow 62, the valve 38 closes and establishes suction between the piston 35 and the suction inlet 11. The atmosphere which exists inside the cylindrical body 30 above the piston is exhausted through the delivery outlet 12 which is constituted in the embodiment shown by the opening 31. The atmosphere in the second secondary volume 7 is sucked so as to penetrate into the first secondary volume 6 by opening the valve member 55. The suction which occurs in the second secondary volume 7 enables oil contained in the engine unit to be sucked in because of the pressure difference that is produced between the atmosphere outside the receptacle 1 and that acts on the oil to be emptied out, and the pressure that exists inside the second secondary volume 7.

To suck out all of the oil contained in the engine unit and to empty it into the bottom 4 of the receptacle 1, it suffices to move the control rod 36 successively up and down.

Given the structure of the device as described above, even if it should accidentally be tilted, the constriction 23 creates a obstacle to the flow of oil, thereby preventing it from penetrating into the first auxiliary volume 21 and thus coming up to the orifice 8. Nevertheless, it should be observed that even if oil were to penetrate into said first auxiliary volume while the device is not in use, the closure stud 57 would prevent the oil from flowing into the first secondary volume 6.

In the above-described structure, the delivery outlet 12 from the pump coincides with the opening 31. Thus, in order to ensure that the atmosphere which is extracted from the receptacle when the control rod 36 is pulled along arrow 62 can escape to the outside 13 of the receptacle, the section of the opening 31 is made in such a manner as to be greater than the cross-section of the control rod 36 so as to leave a sufficient gap between said control rod and the edge of the opening, as shown in the figure.

Nevertheless, the opening 31 could clearly be constituted by a sealed passage for the control rod 36. Under such circumstances, the delivery outlet 12 would need to be made separately by a hole passing through the wall 19 of the receptacle. Such an embodiment would be used in the event of it being necessary for the control rod 36 to be securely held laterally while it is moving in translation.

Furthermore, and for safety reasons, the wall 19 of the receptacle 1 can, for example, include in conventional manner a window of transparent material so that users can verify the level of fluid contained in the receptacle 1 so as to avoid exceeding a determined level which is preferably defined to be below the level of the constriction 23.

FIG. 2 shows a second embodiment of a device of the invention whose main characteristics are described above, in particular with reference to FIG. 1.

In this second embodiment, the device comprises, as in the first embodiment, a pump 10 mounted to co-operate with the receptacle 1 of which only a portion is shown, the suction inlet 11 being situated in the first secondary volume 6 and the delivery outlet 12 opening out to the outside 13 of the receptacle.

In this second embodiment, the pump 10 has a pump body constituted by the separation wall 5 as defined above when describing a first embodiment, a piston 70 that is slidably mounted in the pump body 5 to define first and second chambers 71 and 72 in the first secondary volume 6, with the orifice 8 opening out into the first chamber 71 via the valve member 55, as in the first embodiment shown in FIG. 1.

In addition, the piston 70 is shaped to constitute a second valve member which is open when the piston 70 moves in the pump body so that the volume of the first chamber 71 decreases while the volume of the second chamber 72 increases, and closed when the piston moves so that the volume of the first chamber increases and the volume of the second chamber decreases.

The pump 10 also has a control rod 73 for moving the piston 70 in translation in the pump body 5, one end 74 of the control rod being situated outside the receptacle 1 by passing through a sliding leakproof passage 75 in the wall 76 of the receptacle 1 between the first chamber 71 and the outside 13, means 77 for putting the second chamber 72 into communication with the outside 13 of the receptacle 1, and valve means 78 that are open only in the direction from the second chamber 72 towards the outside 13 of the receptacle.

In FIG. 2, the sliding leakproof passage 75 is represented diagrammatically by a hole surrounded by a sealing bellows connecting the edge of said hole to the piston 70, however it is clear that this leakproof passage could be constituted by other means, e.g. a sealing O-ring, or the like.

In a particularly advantageous embodiment, in particular for industrializing and assembling the device, the means 77 for putting the second chamber 72 into communication with the outside 13 of the receptacle are constituted by a duct 79 passing through the piston 70 and along at least part of the control rod 73 so that both ends 80 and 81 of the duct open out continuously respectively into the second chamber 72 and to the outside 13 of the receptacle. Under such circumstances, the valve means 78 are mounted to co-operate with said duct 79, e.g. at its end 81. Valve means 78 of the kind defined above are well known in themselves and are not described more specifically herein, in order to simplify the present description.

Similarly, in one possible advantageous embodiment, the piston 70 forming the second valve member comprises, for example, a piston body 82 of section smaller than the section of the first secondary volume 6, a circular groove 83 formed in the piston body, an O-ring 84 received in the circular groove, the outer annular section of the O-ring 84 being equal to the inside section of the first secondary volume 6, and its inner annular section being equal to the section at the bottom 85 of the groove 83, the width of the groove being greater than the thickness of the O-ring, and means 86 being provided to put the circular groove 83 into communication with the second chamber 72.

The embodiment shown in FIG. 2 operates identically in terms of general function to the embodiment shown in FIG. 1 as described above. The only difference lies in the operation of the pump 10, but the result obtained is identical to that obtained with the first embodiment.

With a device in accordance with this second embodiment, in order to suck up the fluid after the end 18 of the tube 14 has been dipped in the container that is to be emptied, the process begins by lifting the rod 73. The piston 70 rises in the pump body 5, thereby reducing the volume of the chamber 71. Since this piston is configured as a valve member that is open while it is rising in the pump body 5, it allows the air that is to be found in the chamber 71 to pass so as to fill correspondingly the volume of the chamber 72, the valve member 55 associated with the orifice 8 preventing air from passing from the first secondary volume 6 to the second secondary volume 7. While the rod 73 is moving upwards together with the piston 70, the valve 78 also prevents any air from entering from the outside 13 and penetrating into the second chamber 72.

When the rod 73 reaches the top of the first secondary volume 6, it is moved down and the piston 70 moves with it, thereby reducing the volume of the second chamber 72. Since the piston 70 is configured as a valve member which is closed when the piston moves in the direction for reducing the volume of the second chamber, it serves to compress the air in the chamber 72 and to expel it to the outside 13 of the receptacle 1 via the duct 79 and the valve 78.

Thus, by reciprocating up and down movements of the rod 73 and thus of the piston 70, it is possible to suck out a large fraction of the air contained in the secondary volume 7 of the receptacle 1 and to establish suction therein that acts via the tube 14 to suck in the fluid from the container that is to be emptied, thereby progressively filling the volume 7.

The piston 70 configured as the second valve member as shown in FIG. 2 operates as follows:

When the rod 73 is raised, the O-ring 84 comes into abutment against the bottom portion of the groove 83 and the air contained in the chamber 71 can thus flow from the chamber 71 into the chamber 72 passing through the gap 90 that exists between the piston body 82 and the pump body 5, and then via the means 86 for putting the circular groove 83 into communication with the second chamber.

While the rod 73 is being lowered, the O-ring 84 presses against the top portion of the groove 83 and matches the shape of the inside wall of the pump body 5. In this configuration, the gap 90 is closed and does not allow fluid communication between the second chamber 72 and the first chamber 71 via the communication means 86. The piston configured as a valve member is thus in the above-defined closed direction. This is the configuration shown in FIG. 2.

What is claimed is:

1. A device usable, in a medium where there exists an atmosphere under pressure and a force of gravity, to empty a container of viscous fluid, the device comprising:

a receptacle (1) defining a main volume (2) suitable for containing said viscous fluid, said receptacle being shaped to be suitable for placing in said medium so that the main volume has a top portion (3) and a bottom portion (4);

a pump (10) having a suction inlet (11) and a delivery outlet (12);

a tube (14) including an inlet opening (15) and an outlet opening (16); and means (17) for mounting the tube (14) in association with the receptacle (1) in such a manner that the inlet and outlet openings (15, 16) are situated respectively outside and inside the receptacle (1), the end (18) of the tube (14) including the inlet opening (15) being suitable for dipping into the container that is to be emptied;

the device being characterized by the fact that it further comprises a separation wall (5) for defining first and second secondary volumes (6, 7) inside the main volume (2), the first secondary volume (6) including at least a fraction (9) of the top portion (3) of the main volume (2), and an orifice (8) made through the separation wall (5) to put the first and second secondary volumes (6, 7) into communication with each other, said orifice opening out into the second secondary volume (7) in said fraction (9) of the top portion (3) of the main volume (2), by the fact that said pump (10) is mounted to co-operate with the receptacle (1) so that its suction inlet (11) is situated in the first secondary volume (6), and its delivery outlet (12) opens out to the outside (13) of the receptacle (1), and that the outlet opening (16) of the tube (14) is situated in the second secondary volume (7);

the second secondary volume (7) being subdivided into first and second auxiliary volumes (21, 22), these two auxiliary volumes being in communication via a constriction (23) formed between the wall (19) of the receptacle (1) and the separation wall (5), said constriction constituting a large head loss for the viscous fluid, the first auxiliary volume (21) being situated in the top portion (3) of the main volume (2), the orifice (8) opening out into said first auxiliary volume (21).

2. A device according to claim 1, characterized by the fact that the end (18) of the tube that includes the inlet opening is flexible.

3. A device according to claim 1, characterized by the fact that it has a first valve member (55) mounted to co-operate with the orifice (8) in such a manner that said first valve member is open for flow from the second secondary volume (7) towards the first secondary volume (6).

4. A device according to a claim 1, characterized by the fact that the pump (10) comprises a cylindrical body (30), a first end (33) of the cylindrical body being secured in leakproof manner to the wall (19) of the receptacle (1), said receptacle having an opening (31) to put the inside (32) of the cylindrical body (30) into communication with the outside (13) of the receptacle, the cylindrical body (30) opening out at its other end (34) into the first secondary volume (6); a first piston (35) slidably mounted in the cylindrical body (30); a first control rod (36) for moving the first piston in translation, one end (37) of the first control rod being situated outside the receptacle (1) by passing without sealing through the opening (31); and a valve (38) mounted to co-operate with the first piston (35), the valve being open when the first control rod (36) penetrates in translation into the cylindrical body (30), and being closed when the first control rod moves out from the cylindrical body.

5. A device according to claim 4, characterized by the fact the the separation wall (5) is constituted by a cylindrical sleeve (40) that is longer than the cylindrical body (30), the sleeve being secured at one of its ends (41) to the wall (19) of the receptacle so as to be substantially concentric with the cylindrical body (30) and co-operating therewith to define a first annular space (43) between its inside face (45) and the outside face of the cylindrical body, and being constituted by a plug (44) to close the other end (42) of the sleeve in leakproof manner.

6. A device according to claim 5, characterized by the fact that the first auxiliary volume (21) forms a second cylindrical annular space being shorter than the length of the sleeve.

7. A device according to claim 3, characterized by the fact that, said pump (10) being mounted to co-operate with the receptacle (1) in such a manner that its suction inlet (11) is situated in the first secondary volume (6) and its delivery outlet (12) opens out to the outside (13) of the receptacle (1), the pump comprises a pump body, said pump body being constituted by the separation wall (5), a second piston (70) slidably mounted in said pump body to define first and second chambers (71, 72) in said first secondary volume (6), said orifice (8) opening out into the first chamber (71), said second piston (70) being shaped to constitute a second valve member so that the second valve is open when the piston moves in the pump body so that the volume of the first chamber decreases and the volume of the second chamber increases, and being closed when the piston moves so that the volume of the first chamber decreased and the volume of the second chamber increases, and being closed when the piston moves so that the volume of the first chamber increases and the volume of the second chamber decreases, a second control rod (73) for moving said second piston in translation in said pump body, one end (74) of said second control rod being situated outside the receptacle (1) and passing through a sliding sealed passage (75) in the wall (76) of the receptacle between the first chamber (71) and the outside (13), means (77) for providing communication between the second chamber (72) and the outside (13) of said receptacle (1), and valve means (78) having an open direction only from the second chamber (72) towards the outside (13) of said receptacle.

8. A device according to claim 7, characterized by the fact that the means (77) for putting the second chamber (72) into communication with the outside (13) of said receptacle are constituted by a duct (79) passing through said second piston (70) and along at least part of said second control rod (73) so that its ends (80, 81) open out constantly respectively into the second chamber (72) and to the outside (13) of said receptacle, said valve means (78) being mounted to co-operate with said duct (79).

9. A device according to claim 7, characterized by the fact that said second piston (70) constituting a second valve member comprises a piston body (82) of outside section smaller than the section of said first secondary volume (6), a circular groove (83) formed in said piston body, and an O-ring (84) disposed in said circular groove, the outer annular section of the O-ring being equal to the section of the bottom of the groove, the width of said groove being greater than the thickness of said O-ring, and means (86) for putting the circular groove into communication with the second chamber (72).

* * * * *